US009636720B1

(12) United States Patent
West

(10) Patent No.: US 9,636,720 B1
(45) Date of Patent: May 2, 2017

(54) DRAIN CLEANER ASSEMBLY

(71) Applicant: Brent West, Bellevue, MI (US)

(72) Inventor: Brent West, Bellevue, MI (US)

( * ) Notice: Subject to any disclaimer, the term of this patent is extended or adjusted under 35 U.S.C. 154(b) by 218 days.

(21) Appl. No.: 13/859,227

(22) Filed: Apr. 9, 2013

Related U.S. Application Data

(63) Continuation-in-part of application No. 13/847,272, filed on Mar. 19, 2013, now abandoned.

(60) Provisional application No. 61/612,613, filed on Mar. 19, 2012.

(51) Int. Cl.
*A47K 1/14* (2006.01)
*B08B 9/027* (2006.01)

(52) U.S. Cl.
CPC ..... *B08B 9/027* (2013.01)

(58) Field of Classification Search
CPC ..... E03C 1/30; E03C 1/2665; E03C 1/264; E03C 1/266
USPC ..... 4/287–295
See application file for complete search history.

(56) References Cited

U.S. PATENT DOCUMENTS

| | | | | |
|---|---|---|---|---|
| 2,197,716 | A | 4/1940 | Whitaker | |
| 2,283,780 | A | 5/1942 | Ahern | |
| 2,331,055 | A * | 10/1943 | Smith | 4/291 |
| 2,479,485 | A * | 8/1949 | Frank | 4/287 |
| 4,587,032 | A | 5/1986 | Rogers | |
| 4,825,477 | A | 5/1989 | Aranda | |
| 4,969,491 | A | 11/1990 | Kiplinger | |
| 5,141,166 | A * | 8/1992 | Maynard, Jr. | 241/46.015 |
| 5,630,883 | A | 5/1997 | Steer et al. | |
| 5,946,990 | A | 9/1999 | Bonacci | |
| 6,136,768 | A | 10/2000 | Dawson et al. | |
| 6,363,544 | B1 * | 4/2002 | Ryan | 4/287 |
| 7,802,739 | B2 | 9/2010 | Scorvo et al. | |
| 2009/0293214 | A1 | 12/2009 | Ackerman et al. | |
| 2011/0138527 | A1 * | 6/2011 | Siena et al. | 4/295 |

* cited by examiner

*Primary Examiner* — Christine Skubinna
(74) *Attorney, Agent, or Firm* — King & Partners, PLC

(57) ABSTRACT

A drain cleaner assembly for use in association with a wastewater drain including: a strainer body, wherein the strainer body includes at least one sidewall having an inner surface, an outer surface, an upper end, and a lower end, and wherein the upper end terminates in an annular flange; a drain closure, wherein the drain closure includes an upper end and a lower end, and wherein the lower end includes an annular channel for retaining a seal member; a drain shaft, wherein the drain shaft includes an upper and a lower end, and wherein the upper end is associated with the drain closure; at least one non-displaceable blade; and at least one displaceable blade associated with the drain shaft, wherein the displaceable blade is rotatably displaceable upon at least one of rotational and linear displacement of the drain closure.

1 Claim, 13 Drawing Sheets

DRAIN CLEANER ASSEMBLY

CROSS-REFERENCE TO RELATED APPLICATIONS

This application is a continuation-in-part of U.S. application Ser. No. 13/847,272, filed Mar. 19, 2013, entitled "DRAIN CLEANER ASSEMBLY," which claims the benefit of U.S. Provisional Application Ser. No. 61/612,613, filed Mar. 19, 2012, entitled "DRAIN CLEANER ASSEMBLY," which are hereby incorporated herein by reference in their entirety—including all references cited therein.

BACKGROUND OF THE INVENTION

1. Field of the Invention

The present invention relates in general to a drain cleaner assembly and, more particularly, to a wastewater drain cleaner assembly for a bathtub, shower, and/or sink that comprises a fixed blade and a displaceable blade that cut drain debris (e.g., hair, paper products, etcetera).

2. Background Art

Various types of drain cleaners have been known in the art for years, and are the subject of a plurality of publications and patents, including, for example: United States Patent Application Publication Number 2009/0293214 entitled "Drain Clog Remover and Shaft Usable Therewith," U.S. Pat. No. 7,802,739 entitled "Manually Operable Drain Device," U.S. Pat. No. 6,136,768 entitled "Drain Cleaner," U.S. Pat. No. 5,946,990 entitled "Drain Assembly Removal Tool and Method," U.S. Pat. No. 5,630,883 entitled "Method of Cleaning Drains Utilizing Halogen-Containing Oxidizing Compound," U.S. Pat. No. 4,969,491 entitled "Acid Drain Opening System," U.S. Pat. No. 4,825,477 entitled "Hair Retriever Tub Drain Device," U.S. Pat. No. 4,587,032 entitled "Drain Cleaner," U.S. Pat. No. 2,283,780 entitled "Dispenser of Solution and Application Thereof," and U.S. Pat. No. 2,197,716 entitled "Drain Cleaner"—all of which are hereby incorporated herein by reference in their entirety including the references cited therein.

United States Patent Application Publication Number 2009/0293214 appears to disclose an apparatus for removing drain clog material from a drain pipe assembly. The assembly has: (a) a container, and (b) a shaft. The container defines a reservoir adapted to receive a drain cleaning composition. The container also has an outlet. The shaft is attached to the outlet of the container and is in fluid communication with the container. The shaft also has an X-direction, a Y-direction perpendicular thereto, and a Z-direction perpendicular to both the X- and Y-directions, in addition to a plurality of barbs extending outwardly. The barbs have a force to remove of less than 20 pounds and a peak bend force of less than 4 pounds.

U.S. Pat. No. 7,802,739 appears to disclose a manually operable device and a method for separating solid waste materials from liquid to be disposed of through a drain, and for reducing the size of pieces of such solid waste materials for more efficient disposal through the drain. A size reduction assembly is manually movable with respect to a stationary body and may include perforated material for catching solid material from a liquid flowing into the drain, and at least one cutting or ripping or abrasion component for reducing the size of pieces of the solid material into smaller pieces that may then pass downward through the drain. In some embodiments the size reduction assembly may be driven downward by pressure from a hand or foot. The reduced-size pieces of material are flushed from the device by liquid draining through the device.

U.S. Pat. No. 6,136,768 appears to disclose a water-dispersible effervescent drain cleaner having a composition of approximately 20-60% by weight of a mixture of metal hydroxides, 20-40% hypochlorite generator, and 10-40% effervescent materials. Lubricants, colors and fragrances may also be present. The components of this mixture are compressed into tablets, pellets, granules, or high density powder forms. The particles are purportedly of sufficient density to drop through water to the point of a clog. The effervescent materials work to break up the tablets or pellets and to agitate the mixture. The hypochlorite generator, in conjunction with the hydroxides reacts to dissolve hair. The hydroxide and hypochlorite generate heat that will dissolve grease and soap clogs and accelerate the dissolution of hair.

U.S. Pat. No. 5,946,990 appears to disclose a drain assembly removal tool and method for removing a drain assembly, including providing a hand grip, two prongs extending from the hand grip, and cutting means attached to at least one prong for cutting into a strainer plug body of a drain assembly. In one aspect, an adjustable saw blade includes a multi-position slot for mounting the saw blade to the prong for providing adjustment to contact the saw blade to the strainer plug body of the bathtub drain. In one aspect, a serrated helical wheel provides adjustment to contact the saw blade to the strainer plug body of the bathtub drain. In another aspect, an adjustable cutter wheel includes a serrated helical wheel for providing adjustment to contact the cutter wheel to the strainer plug body of the bathtub drain.

U.S. Pat. No. 5,630,883 appears to disclose a method of substantially removing a restriction from a drain pipe system including the steps of introducing a cleaning composition containing a non-caustic drain opening active to the pipe system, activating the cleaning composition by adding a sufficient amount of liquid to the drain pipe system while maintaining a flow-through state through the pipe system, allowing the drain opening active to remain in contact with the restriction for a sufficient time to substantially degrade the restriction, and rinsing the drain opening active from the pipe system. The water flow rate through the pipe system is improved by at least 0.7 liters/minute after 16 hours of the drain opening active contacting the restriction.

U.S. Pat. No. 4,969,491 appears to disclose a system for administering acid to a clogged drain, and the method of using the system. The system includes a coupling to which a container of the acid can be threadedly secured. The coupling includes a piercing nipple, which penetrates a seal on the acid bottle. The nipple is hollow, and the acid passes from the bottle through the nipple and into a rigid, but arcuately deformable, tube that is connected to the coupling and is in fluid communication with the nipple. The tube is inserted into the clogged drain, until it is embedded in the clog. The acid is delivered directly to the clog, where it reacts with and dissolves the same.

U.S. Pat. No. 4,825,477 appears to disclose a pair of spring loaded cylinders each supporting an upwardly projecting post mounted in a drain. A strainer is attached to the drain with the posts projecting upwards through holes in the strainer. A disposable insert, having a hooked material such as Velcro® sheet on its lower surface, is mounted on a distal end of the posts. Foot pressure on a cover plate mounted on a top surface of the insert forces the Velcro® to contact the strainer and remove all impinged hair and debris.

U.S. Pat. No. 4,587,032 appears to disclose a drain cleaner composition of reduced toxicity which comprises an organic solvent, preferably a water soluble solvent, a surfactant, preferably a fluorosurfactant, a hair decomposer, such as a thioglycolate salt, a water soluble salt for increasing the density of the formulation, and a thickener to increase the viscosity of the formulation. The composition is preferably formulated as an aqueous solution and other ingredients of reduced toxicity such as accelerators for hair decomposition, corrosion inhibitors, fragrances and dyes may also be included.

U.S. Pat. No. 2,283,780 appears to disclose dispensers of solution, and the like, and its application to toilet bowl fixture surfaces and to drain-pipe traps, the access to which is confined to an opening of limited proportions and the passage therefrom to within the trap is considerably out of alignment therewith and ordinarily inaccessible.

U.S. Pat. No. 2,197,716 appears to disclose a device for flushing drains of sinks and the like to effect cleaning thereof when clogged. In particular, the '716 patent appears to provide a device whereby a water lead is provided from a faucet to a drain pipe or the like, so that the pipe can be cleaned with dispatch and without possibility of leakage at the faucet or at the inlet of the drain pipe.

While the above-identified publications and patents do appear to provide various types of drain cleaners and/or solutions for clogged drains, their configurations and/or approaches to resolving clogged drains remains problematic for a plurality or reasons, including, but not limited to, complex mechanical configurations, the use of hazardous, toxic and/or undesirable chemicals—among other things.

It is therefore an object of the present invention to provide a drain cleaner assembly that, among other things, remedies the aforementioned detriments and/or complications associated with the use of the above identified drain cleaners and clogged drain solutions.

These and other objects of the present invention will become apparent in light of the present specification, claims, and appended drawings.

SUMMARY OF THE INVENTION

In one embodiment, the present invention is directed to a drain cleaner assembly for use in association with a wastewater drain comprising: (a) a strainer body, wherein the strainer body includes a sidewall having an inner surface, an outer surface, an upper end, and a lower end, and wherein the upper end terminates in an annular flange; (b) a drain closure, wherein the drain closure includes an upper end and a lower end, and wherein the lower end includes an annular channel for retaining a seal member; (c) a drain shaft, wherein the drain shaft includes an upper and a lower end, and wherein the upper end is associated with the drain closure; (d) one or more non-displaceable blades; and (e) one or more displaceable blades associated with the drain shaft, wherein the displaceable blades are rotatably displaceable upon at least one of rotational and linear displacement of the drain closure.

In a preferred embodiment of the present invention, the displaceable blades are positioned above and contact the non-displaceable blades.

In another preferred embodiment of the present invention, the displaceable blades are positioned below and contact the non-displaceable blades.

In yet another preferred embodiment of the present invention, the displaceable blades and/or the non-displaceable blades include a beveled edge.

In another aspect of the present invention, the displaceable blades are rotatably displaceable upon linear and/or rotational displacement of the drain closure.

In a preferred embodiment of the present invention, the non-displaceable blades are positioned proximate the upper and/or lower end of the strainer body.

In another preferred embodiment of the present invention, the non-displaceable blades are positioned within the inner surface of the strainer body and proximate the upper or lower end of the strainer body.

In yet another preferred embodiment of the present invention, the non-displaceable and/or displaceable blades consist of four cross-pattern blades. Preferably these blades have alternating serrated edges.

In another aspect of the present invention, the upper end of the drain closure includes a knob.

In one preferred embodiment of the present invention, at least a portion of the outer surface of the sidewall of the strainer body is threaded.

In another preferred embodiment of the present invention, the drain shaft includes a ball joint.

In yet another preferred embodiment of the present invention, a seal member is positioned below the annular flange of the strainer body.

In one embodiment, the present invention is also directed to a drain cleaner assembly for use in association with a wastewater drain comprising: (a) a strainer body, wherein the strainer body includes at least one sidewall having an inner surface, an outer surface, an upper end, and a lower end, and wherein the upper end terminates in an annular flange; (b) a drain closure, wherein the drain closure includes an upper end and a lower end, and wherein the lower end includes an annular channel for retaining a seal member; (c) a drain shaft, wherein the drain shaft includes an upper and a lower end, and wherein the upper end is associated with the drain closure; and (d) means for cutting drain debris upon at least one of rotational and liner displacement of the drain closure.

In one embodiment, the present invention is yet further directed to a drain cleaner assembly for use in association with a wastewater drain consisting of: (a) a strainer body, wherein the strainer body includes a cylindrical sidewall having an inner surface, a threaded outer surface, an upper end, and a lower end, and wherein the upper end terminates in an annular flange, and further wherein a non-displaceable blade is positioned proximate the lower end of the strainer body; (b) a drain closure, wherein the drain closure includes an upper end and a lower end, wherein the upper end includes a knob, and further wherein the lower end includes an annular channel having a seal member retained therein; (c) a drain shaft, wherein the drain shaft includes an upper and a lower end, and wherein the upper end is secured to the drain closure; and (d) a displaceable blade associated with the drain shaft, wherein the displaceable blade is rotatably displaceable upon at least one of rotational and linear displacement of the drain closure.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

The invention will now be described with reference to the drawings wherein.

DETAILED DESCRIPTION OF THE INVENTION

Figure 1:
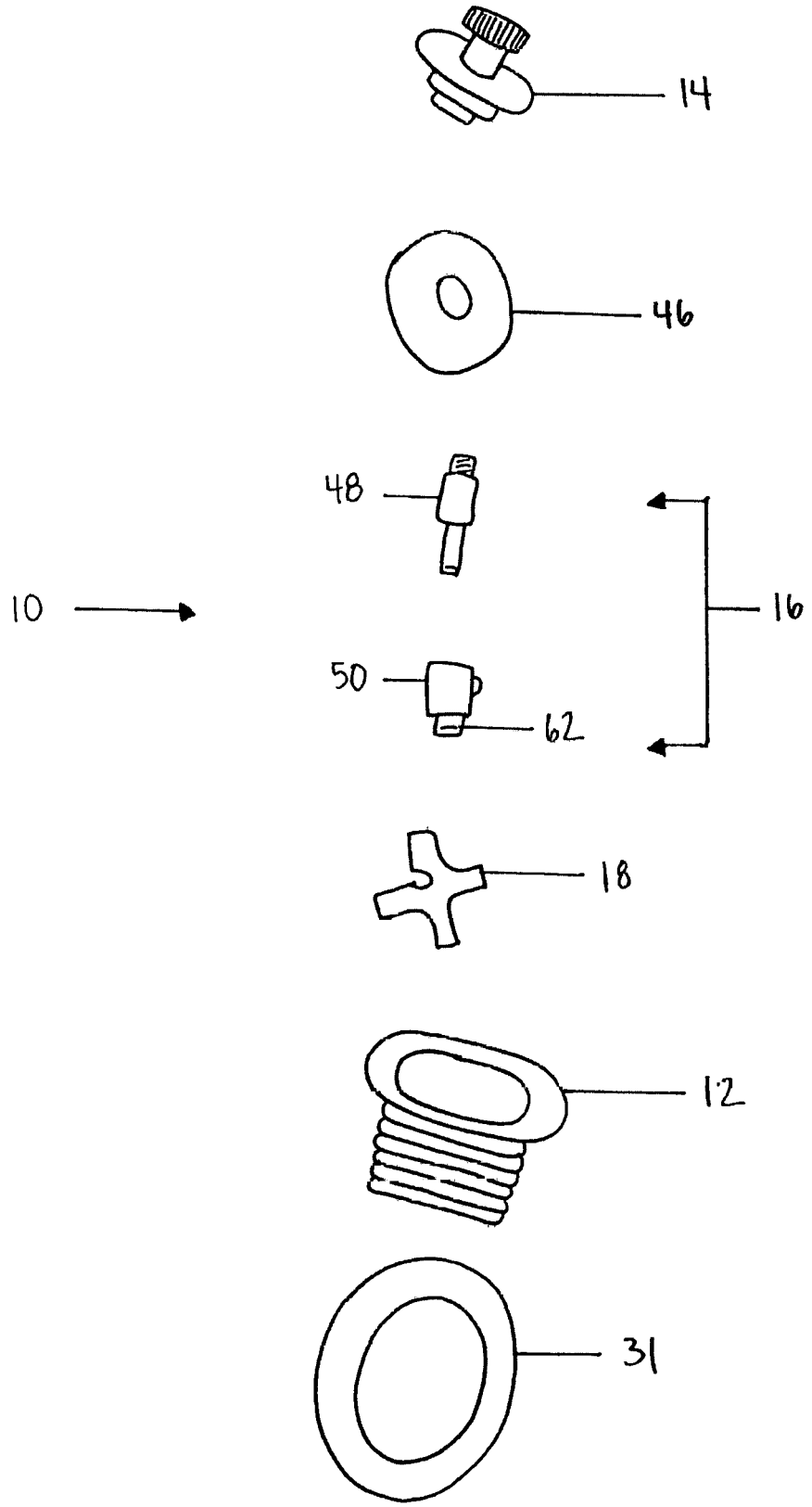
FIG. 1 of the drawings is an exploded perspective view of a drain cleaner assembly fabricated in accordance with the present invention.
Figure 2:
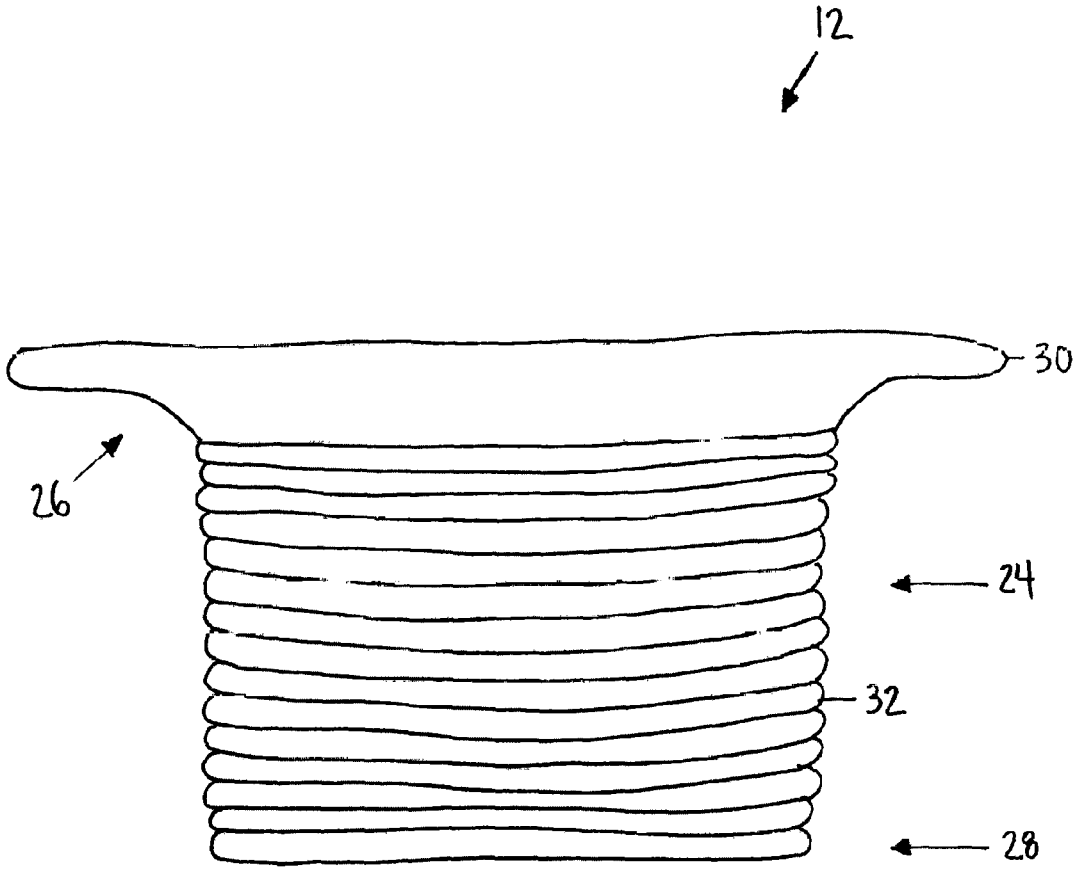
FIG. 2 of the drawings is a side elevational view of a strainer body fabricated in accordance with the present invention.

While this invention is susceptible of embodiment in many different forms, there are shown in the drawings, and will herein be described in detail, several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings, and to FIG. 1 in particular, an exploded perspective view of a first embodiment of drain cleaner assembly 10 is shown that generally comprises strainer body 12, drain closure 14, drain shaft 16, and displaceable blade 18. It will be understood that drain cleaner assembly 10 is preferably used in association with a wastewater drain for a bathtub, shower, basin, and/or sink, and cuts drain debris (e.g., hair, paper products, sludge, solid particles, etcetera) down to a size such that the drain debris is disposable through the associated wastewater drain without the use of hazardous, toxic, and/or undesirable chemicals, and/or complex mechanical solutions. It will be further understood that FIGS. 1-13 provided herein are merely representations of drain cleaner assembly 10 and its sub-components. As such, some of the components may be distorted from their actual scale for pictorial clarity and/or image enhancement.

Referring now to FIGS. 1-4 collectively, in one embodiment, strainer body 12 includes cylindrical sidewall 20 having an inner surface 22, outer surface 24, upper end 26, and lower end 28. Upper end 26 preferably terminates with annular flange 30. Seal member 31 (FIG. 1; e.g., gasket, O-ring, etcetera) is preferably positioned below annular flange 30 of strainer body 12. Outer surface 24 of strainer body 12 preferably includes threads 32. It will be understood that strainer body 12 is adapted for securement to a wastewater drainpipe. Strainer body 12 is preferably fabricated from, for example, woods, metals, natural resins, synthetic resins, plastics, composites, and mixtures thereof.

Figure 3:
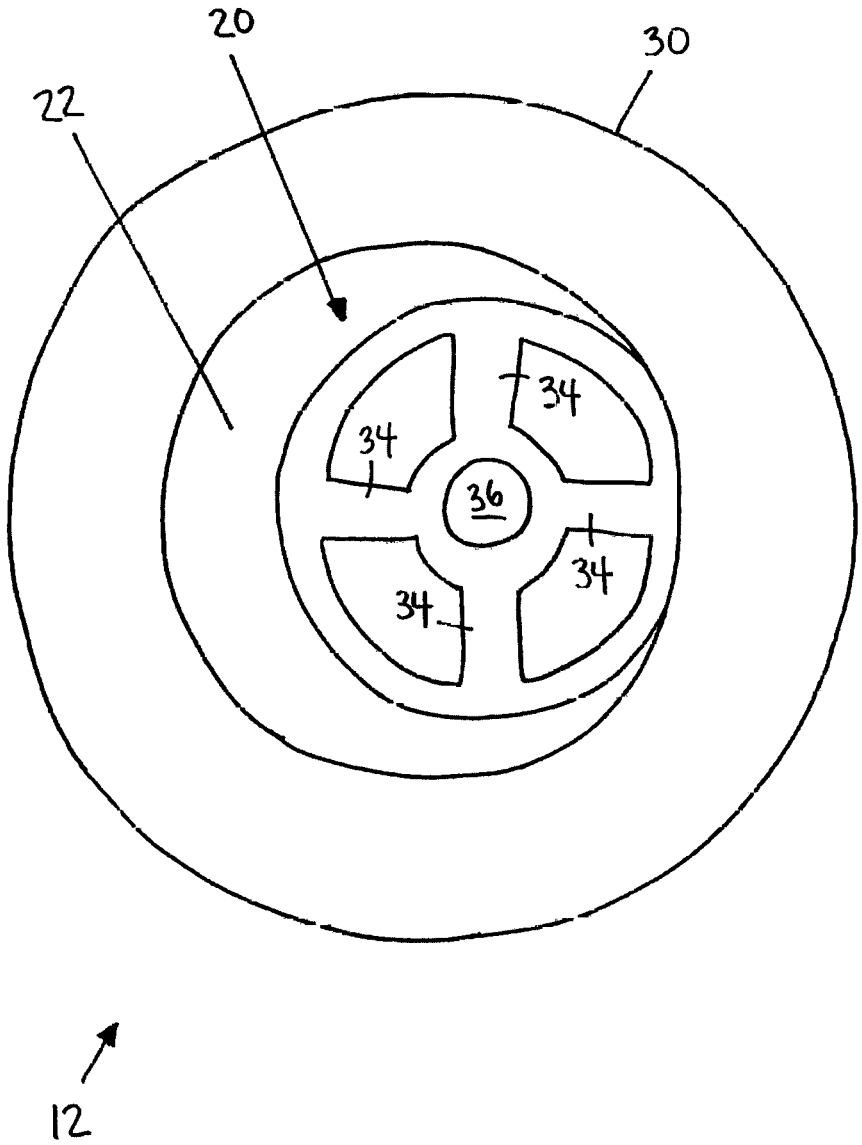
FIG. 3 of the drawings is a top plan view of a strainer body fabricated in accordance with the present invention.
Figure 4:
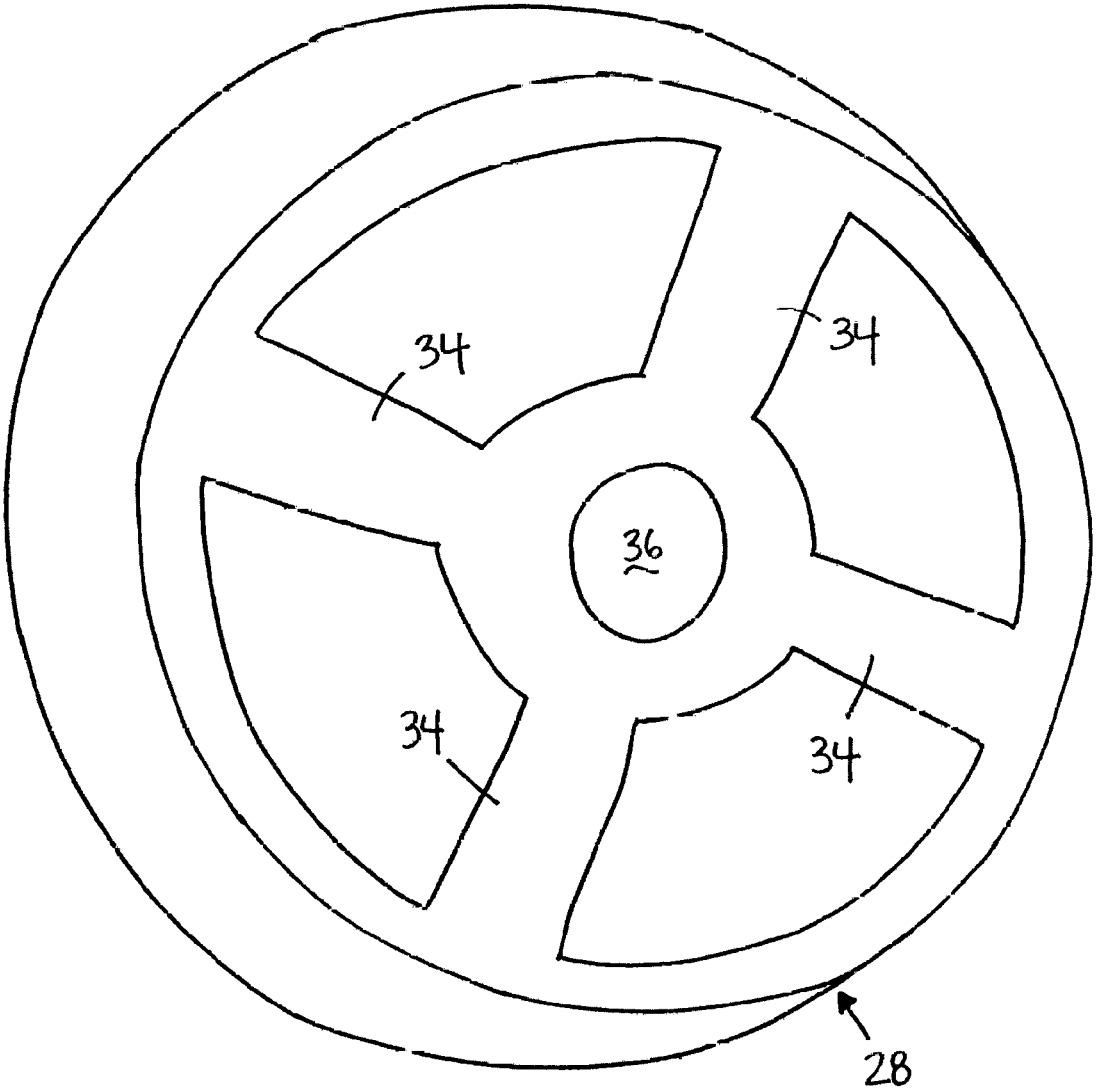
FIG. 4 of the drawings is a bottom plan view of a strainer body fabricated in accordance with the present invention.

As is best shown in FIGS. 3 and 4, in a preferred embodiment of the present invention, strainer body 12 includes one or more fixed or non-displaceable blades 34. Non-displaceable blades 34 may be positioned proximate lower end 28 of strainer body 12 (FIG. 4) and/or may be positioned proximate upper end 26 of strainer body 12. As is best shown in FIG. 4, non-displaceable blades 34 are preferably positioned within inner surface 22 of strainer body 12. Non-displaceable blades 34 preferably comprise and/or consist of four cross-pattern blades, which optionally include central threaded aperture 36. As will be discussed in greater detail below central threaded aperture 36 releasably secures drain shaft 16 and serves as a displacement stop therefore. One or more of non-displaceable blades 34 may include beveled and/or serrated edges.

Figure 5:
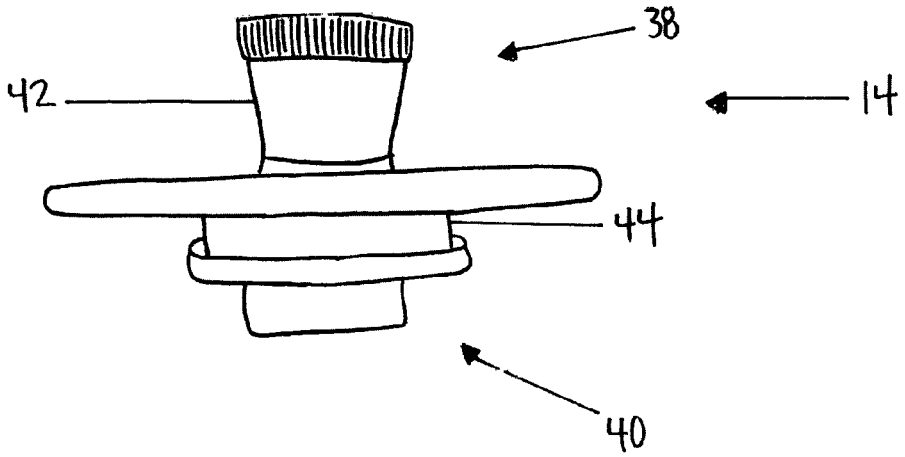
FIG. 5 of the drawings is a side elevational view of a drain closure fabricated in accordance with the present invention.
Figure 6:
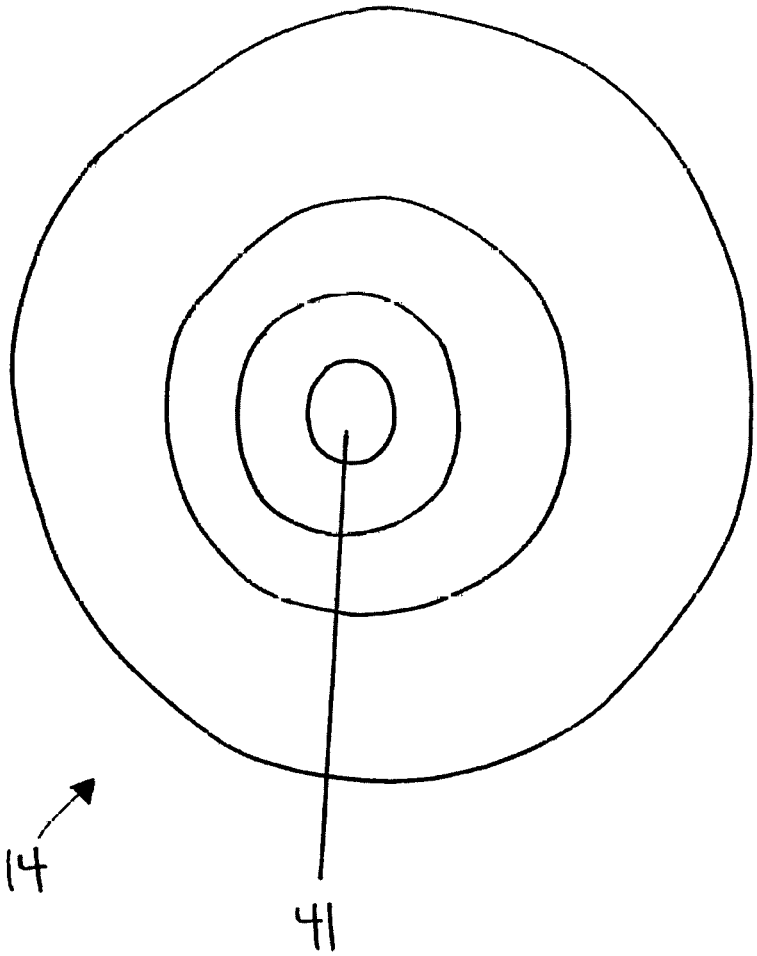
FIG. 6 of the drawings is a bottom plan view of a drain closure fabricated in accordance with the present invention.

Referring now to FIGS. 5 and 6, in one embodiment, drain closure 14 includes upper end 38 and lower end 40. Upper end 38 preferably includes knob 42, and lower end 40 preferably includes annular channel 44 for retaining seal member 46 (FIG. 1; e.g., gasket, O-ring, etcetera). Lower end 40 of drain closure 14 also includes threaded aperture 41 for releasable securement to drain shaft 16.

Figure 7:
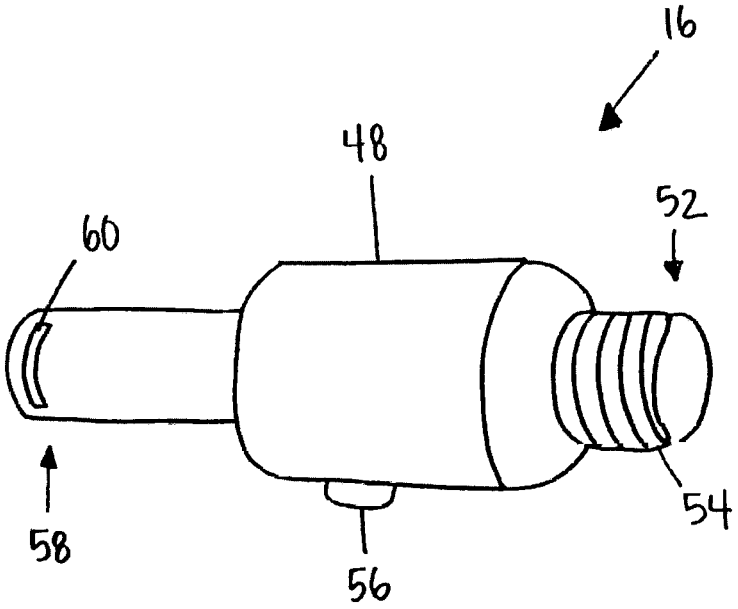
FIG. 7 of the drawings is a top perspective view of a first portion of a drain shaft fabricated in accordance with the present invention.
Figure 8:
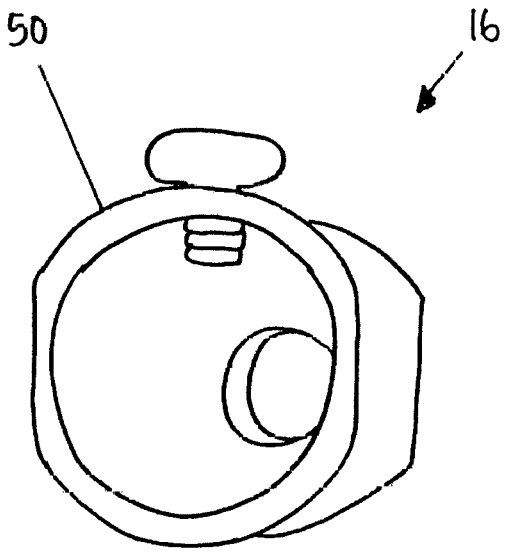
FIG. 8 of the drawings is a perspective view of a second portion of a drain shaft fabricated in accordance with the present invention.
Figure 9:
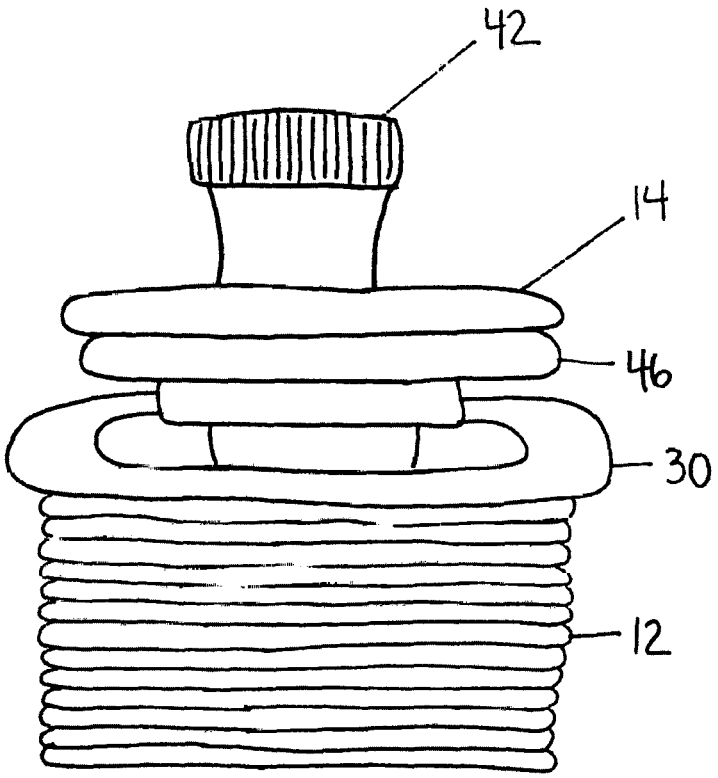
FIG. 9 of the drawings is a side elevational view of a drain cleaner assembly fabricated in accordance with the present invention.
Figure 10:
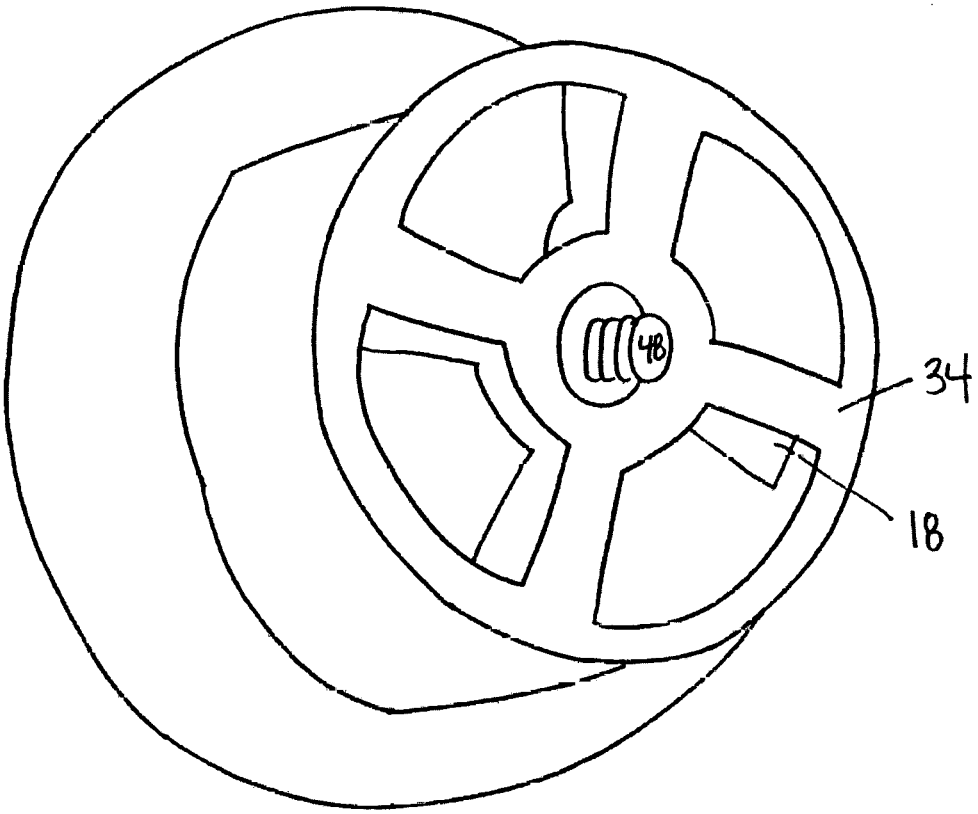
FIG. 10 of the drawings is a bottom perspective view of a drain cleaner assembly fabricated in accordance with the present invention, showing among other things, non-displaceable blades and displaceable blades in an angular overlapping configuration.
Figure 11:
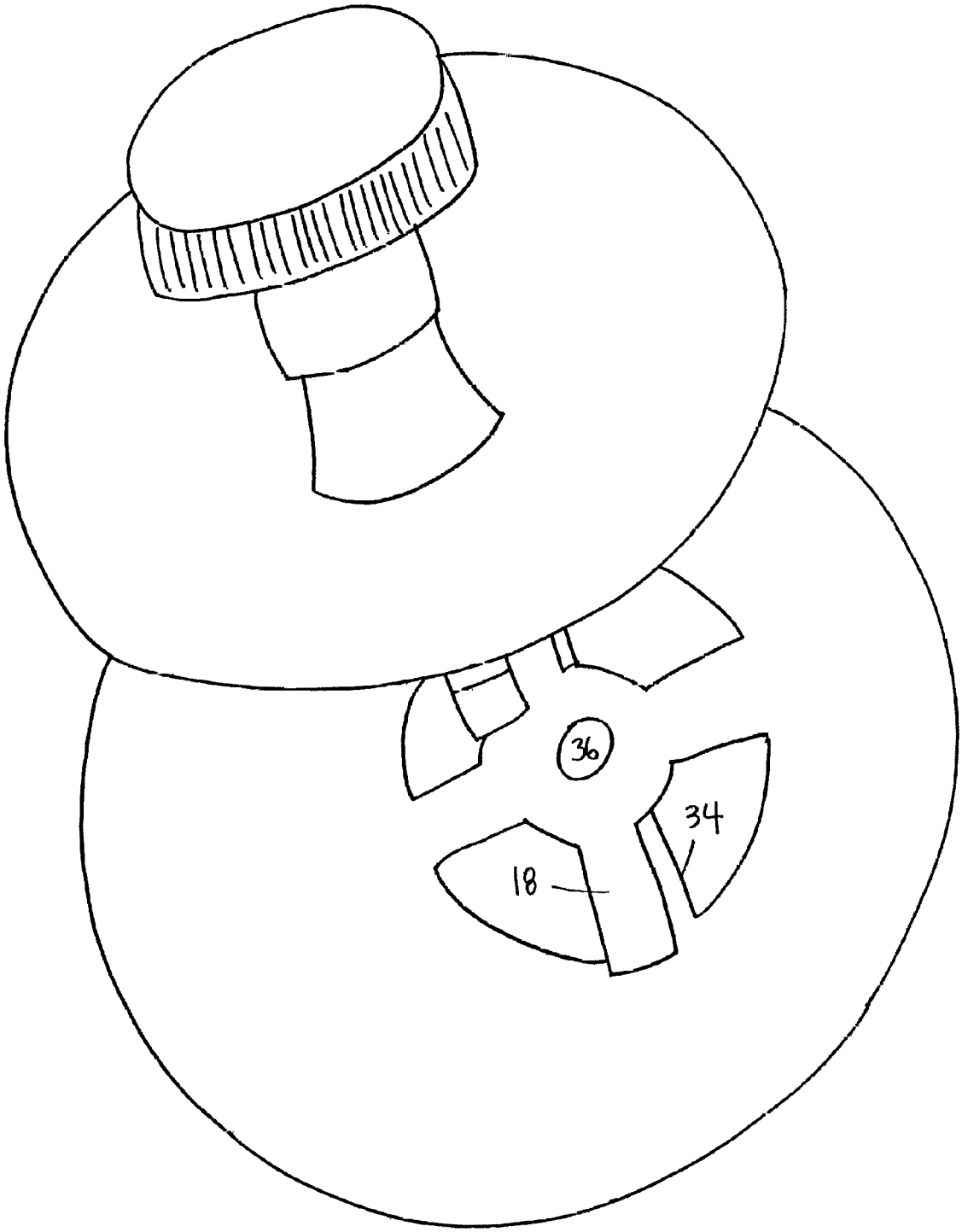
FIG. 11 of the drawings is a top perspective view of a drain cleaner assembly fabricated in accordance with the present invention, showing among other things, non-displaceable blades and displaceable blades in an angular overlapping configuration.
Figure 12:
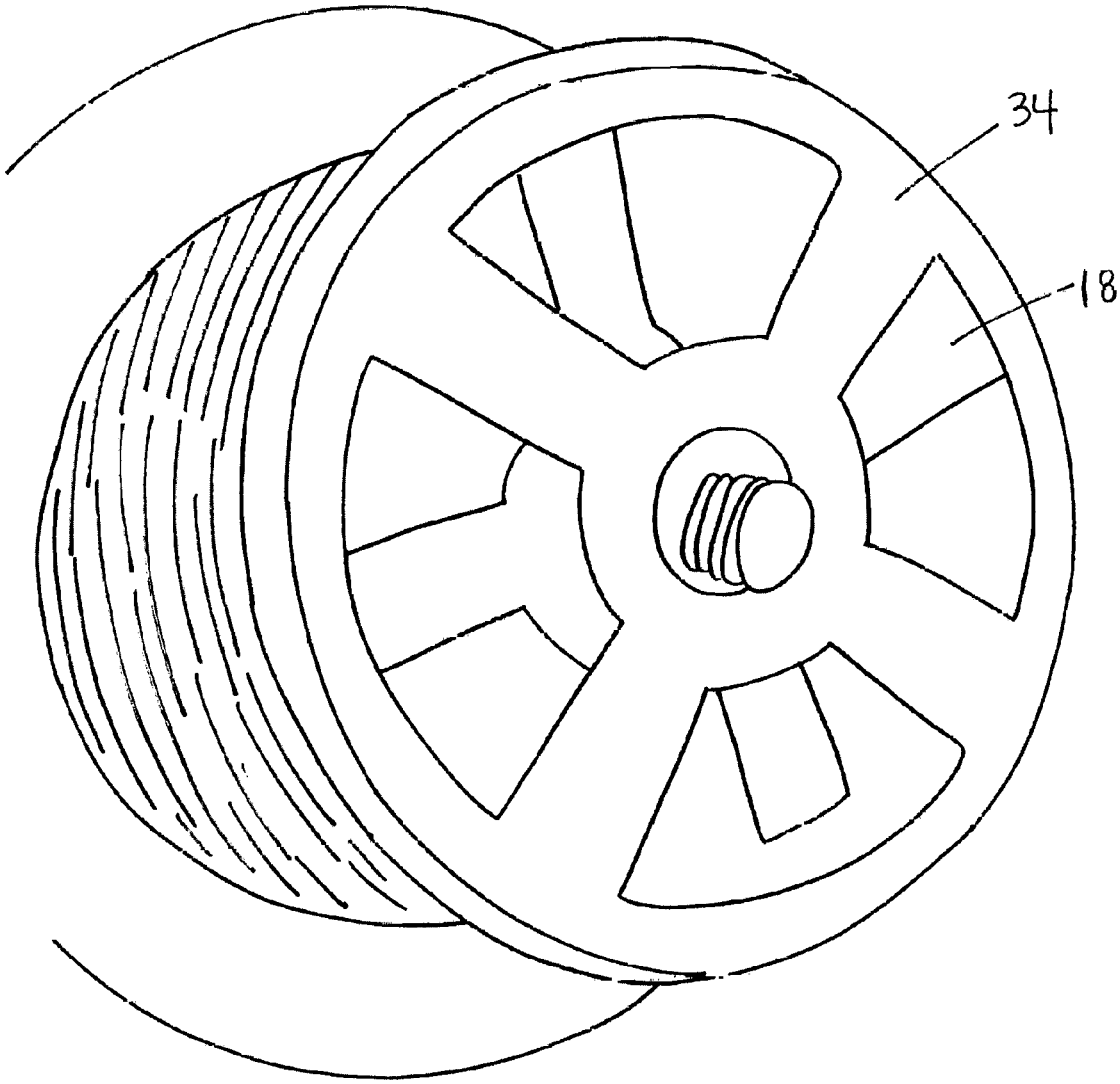
FIG. 12 of the drawings is a bottom perspective view of a drain cleaner assembly fabricated in accordance with the present invention, showing among other things, non-displaceable blades and displaceable blades in an angular non-overlapping configuration.
Figure 13:
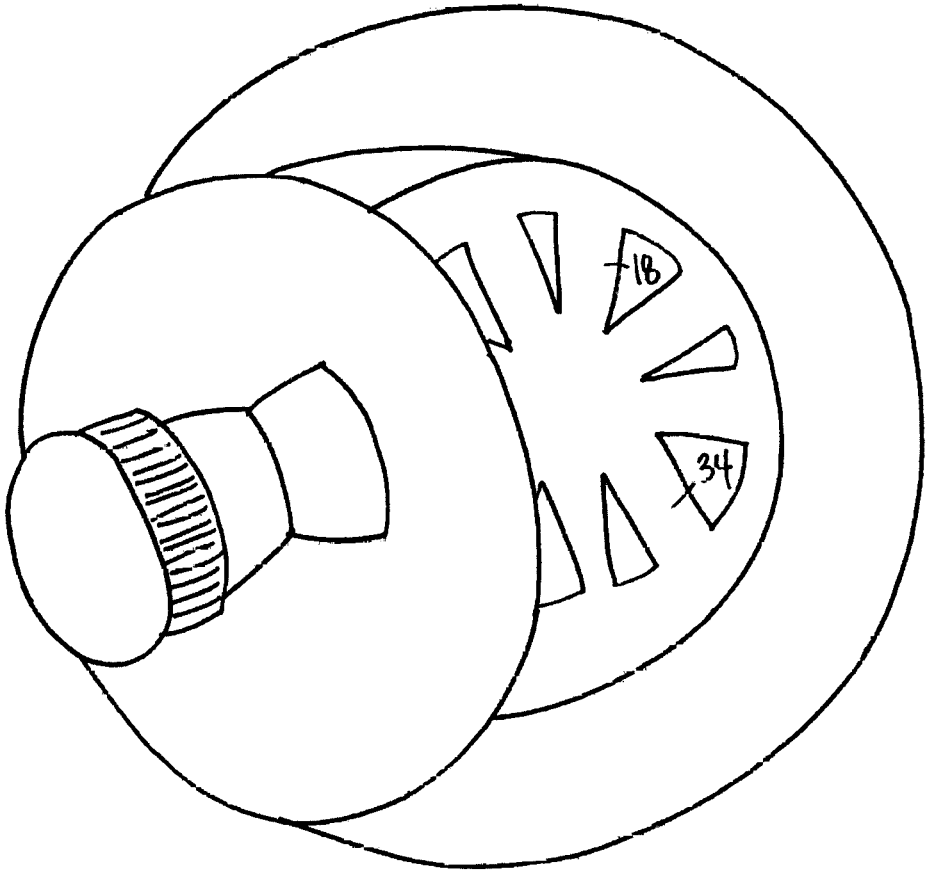
FIG. 13 of the drawings is a top perspective view of a drain cleaner assembly fabricated in accordance with the present invention, showing among other things, non-displaceable blades and displaceable blades in an angular non-overlapping configuration.

Referring now to FIGS. 1, 7, and 8, in one embodiment, drain shaft 16 includes inner piston 48 and outer sleeve 50. It will be understood that inner piston 48 and outer sleeve 50 are mechanically slidable relative to one another. Inner piston 48 preferably includes upper end 52 having threads 54 for releasable securement with female threaded aperture 41 of lower end 40 of drain closure 14. Inner piston 48 also includes ball joint 56 proximate the midpoint. Lower end 58 of drain shaft 16 includes annular channel 60. It will be understood that a retaining ring may be positioned within annular channel 60 to preclude drain shaft 16 from sliding upward past lower end 28 of strainer body 12. For purposes of the present disclosure, upper end 52 of inner piston 48 is secured to lower end 40 of drain closure 14 and lower end 62 of outer sleeve 50 is secured to lower end 28 of strainer body 12. It will be understood that drain shaft 16 is displaceable between at least two positions, namely: a contracted position and an extended position, that correspond to open and closed drain closure positions, respectively. It will be understood that while drain shaft 16 has been disclosed, for illustrative purpose only, as comprising a displaceable, two-piece shaft, one piece shafts such as worm shafts, screw shafts, etcetera are likewise contemplated for use in accordance with the present invention—so long as linear and/or rotational displacement of the same facilitates rotational displacement of associated cutting blades.

Referring now to FIGS. 1-13 collectively, in one embodiment, drain cleaner assembly 10 includes one or more displaceable blades 18. Displaceable blades 18 may be positioned proximate lower end 28 of strainer body 12 and/or may be positioned proximate upper end 26 of strainer body 12. As is best shown in FIGS. 10-13, displaceable blades 18 are preferably positioned within inner surface 22 of strainer body 12. Displaceable blades 18 preferably comprise and/or consist of four cross-pattern blades, which preferably include a central aperture for securement to drain shaft 16. One or more of displaceable blades 18 may include beveled and/or serrated edges.

In one embodiment of the present invention, displaceable blades 18 are positioned above and contact non-displaceable blades 34 (FIG. 10-13). In another embodiment of the present invention, displaceable blades 18 are positioned below and contact non-displaceable blades 34 (not shown).

In accordance with the present invention, displaceable blades 18 rotate upon linear displacement (e.g., upward and/or downward motion) of drain closure 14, and, in turn, drain shaft 16. In further accordance with the present invention, displaceable blades 18 rotate upon rotational displacement (e.g., twisting clockwise and/or counter clockwise) of drain closure 14, and, in turn, drain shaft 16.

In operation, and after installation using conventional techniques, drain cleaner assembly 10 cuts drain debris (e.g., hair, paper products, etcetera) via displaceable blades 18 or via cooperation of displaceable blades 18 with non-displaceable blades 34. In particular, as drain closure 14 and, in turn, drain shaft 16 is manipulated up, down, clockwise, and/or counterclockwise displaceable blades 18 and non-displaceable blades 34 cooperate to cut drain debris with a scissor-type motion. Once cut, the drain debris is allowed to pass through the wastewater drainpipe thus avoiding the need to extract, for example, copious quantities of hair and the like from the drain. Notably, the drain is cleaned in the complete absence of hazardous, toxic, and/or undesirable chemicals.

The foregoing description merely explains and illustrates the invention, and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A drain cleaner assembly for use in association with a wastewater drain, consisting of:

a strainer body, wherein the strainer body includes a cylindrical sidewall having an inner surface, a threaded outer surface, an upper end, and a lower end, and wherein the upper end terminates in an annular flange, and further wherein a non-displaceable blade is positioned proximate the lower end of the strainer body;

a drain closure, wherein the drain closure includes an upper end and a lower end, wherein the upper end includes a knob, and further wherein the lower end includes an annular channel having a seal member retained therein;

a drain shaft, wherein the drain shaft includes an upper and a lower end, and wherein the upper end is secured to the drain closure; and a displaceable blade associated with the drain shaft, wherein the displaceable blade is rotatably displaceable upon at least one of rotational and linear displacement of the drain closure.

* * * * *